US005504468A

United States Patent [19]

Hattori et al.

[11] Patent Number: 5,504,468

[45] Date of Patent: Apr. 2, 1996

[54] ELECTROMAGNETIC SOLENOID

[75] Inventors: Masaichi Hattori; Osamu Shoji, both of Aichi, Japan

[73] Assignee: Kabushiki Kaisha Tokai Rika Denki Seisakusho, Aichi, Japan

[21] Appl. No.: 437,230

[22] Filed: May 8, 1995

[30] Foreign Application Priority Data

May 16, 1994 [JP] Japan ..... 6-100502
Jun. 3, 1994 [JP] Japan ..... 6-122196

[51] Int. Cl.[6] ..... H01F 7/00

[52] U.S. Cl. ..... 335/278

[58] Field of Search ..... 335/278; 336/90–107, 336/192

[56] References Cited

U.S. PATENT DOCUMENTS 4,954,801 9/1990 Urbanski et al. ..... 336/90
5,132,655 10/1992 Suzuki et al. ..... 336/192
5,153,550 10/1992 Sugiura et al. ..... 336/192
5,382,933 1/1995 Nakamura et al. ..... 335/278

*Primary Examiner*—Leo P. Picard
*Assistant Examiner*—Raymond M. Barrera
*Attorney, Agent, or Firm*—Finnegan, Henderson, Farabow, Garrett & Dunner

[57] ABSTRACT

An electromagnetic solenoid includes a body unit of plastic integrally including a cylindrical bobbin around which a coil is wound and a connector housing, a plunger arranged in the bobbin, a yoke fixed on the body unit, by insertion molding, to lead magnetic fluxes from the coil onto the side of the plunger, a terminal piece insertion-molded to the body unit in a protruding manner into the connector housing, a coil connection piece of the terminal piece for connecting the terminal of the coil protruding from the side portion of the body unit and a case attached to the body unit to cover the coil and bobbin with an insulation space for insulation defined around the coil connection piece.

8 Claims, 4 Drawing Sheets

ELECTROMAGNETIC SOLENOID

BACKGROUND OF THE INVENTION

1. Field of the Invention

The present invention relates to an electromagnetic solenoid including a bobbin around which a coil is wound and a connector housing incorporating a terminal piece for supplying power to the coil, and more particularly to an electromagnetic solenoid in which the portion connecting the tip of the coil and the terminal piece is protected.

1. Related Art

For example, in motor vehicles, a large number of electromagnetic solenoids are used for exchange of the operation state of load. The electromagnetic solenoid used in this case generally includes a core combined with the coil and a plunger which moves towards the core in response to electric energization of the coil. Further, in order to improve the workability of assembling a motor vehicle on a production line, a connector housing is connected to the tip of the lead wire led from said coil.

The provision of the core in above prior art electromagnetic solenoid can provide relatively large attraction force. But in the use for which small attraction force suffices, the presence of the core leads to a redundant increase in the weight. This goes against the present situation of motor vehicles where achievement of the lightweight is required. Further, the presence of the connector housing as a separate component disadvantageously increases the number of components constituting the electromagnetic solenoid.

The electromagnetic solenoid having the conventional structure, in which the connector and protection cover are formed as components separate from the body including a bobbin and coil, has a problem of an increase in the number of components. In addition, the work of attaching the protection cover so that it is not fallen off is relatively troublesome and inferior in production workability.

SUMMARY OF THE INVENTION

The present invention has been completed in view of the above situation. An object of the present invention is to provide an electromagnetic solenoid which is preferable as a driving source for the load for a motor vehicle due to achievement of the light weight of the entire body, permits the number of components to be reduced and improves production workability.

In order to attain the above object, the present invention has a structure comprising a body unit made of plastic integrally including a cylindrical bobbin around which a coil is wound and a connector housing with an insertion-molded terminal piece for supplying power to the coil; a plunger arranged in said bobbin; and a yoke fixed on said body unit, by insertion molding, to lead magnetic fluxes from said coil onto the side of said plunger.

In this case, a structure may be used which further comprises an auxiliary yoke attached to said body unit so as to cover said coil and a connection portion between said coil and said terminal piece and to abut on said plunger.

In order to attain above object, the present invention provides an electromagnetic solenoid characterized by comprising a body unit of plastic integrally including a cylindrical bobbin around which a coil is wound and a connector housing; a plunger arranged in said bobbin; a terminal piece insertion-molded to said body unit in a protruding manner into said connector housing, the coil connection piece of said terminal piece for connecting the terminal of said coil protruding from the side portion of said body unit; and a metallic case attached to said body unit so as to cover said coil and bobbin and so that a space for insulation is present around said coil connection piece, wherein a cap member is formed integrally to said case so that it is bent to close said space for insulation and its tip abuts on said body unit.

The present invention also provides an electromagnetic solenoid characterized by comprising a body unit of plastic integrally including a cylindrical bobbin around which a coil is wound and a connector housing; a plunger arranged in said bobbin; a terminal piece insertion-molded to said body unit in a protruding manner into said connector housing, the coil connection piece of said terminal piece for connecting the terminal of said coil protruding from the side portion of said body unit; and a metallic case attached to said body unit so as to cover said coil and bobbin and so that a space for insulation is present around said coil connection piece, wherein a cover portion is formed integrally to said unit so that it is extended integrally from said connector housing to close said space for insulation.

When the cover portion is provided, the coil connection piece of said terminal piece may be made longer than the length extended out from said cover portion and can be bent in a state along said coil.

In the state where a coil has been electrically energized, a magnetic circuit is formed in which the magnetic flux generated in the coil is led to the side of a plunger through a yoke. Thus, the plunger is held on the position minimizing the magnetic resistance of said magnetic circuit. In this case, since there is not a core unlike the conventional structure, large attraction force is not obtained but the light weight of the entire structure can be achieved. Further, since a connector housing with an insertion-molded terminal piece for supplying power to the coil and a cylindrical bobbin around which a coil is wound and a plunger arranged in said bobbin are integrally formed as a body unit and a yoke is fixed on said body unit by insertion molding, the number of components can be reduced.

Since an auxiliary yoke may be attached to said body unit so as to cover said coil and a connection portion between said coil and said terminal piece, damaging of the coil and short-circuiting at the terminal piece can be prevented.

In the electromagnetic solenoid of the present invention, since a bobbin around which a coil is wound and a connector housing with an insertion-molded terminal piece having a coil connection piece for connecting the terminal of said coil are integrally formed as a body unit of plastic, the number of components can be reduced. Further, a metallic case is attached to the body unit so as to cover said coil and bobbin and so that a space for insulation is present around said coil connection piece and a cap member is formed in said case to close said space for insulation. Occurrence of coil damaging and short-circuiting at the coil connection piece can be prevented. In this case, since the above cover member is formed integrally to the case, there is no fear of its falling-off and the number of components can be reduced. In addition, the cover has only to be bent to close the space for insulation so that production workability can be improved. Further, the cap member abuts on the body unit in a bent state so that it is prevented from being dropped in the space for insulation.

Also in the electromagnetic solenoid of the present invention, since the bobbin and the connector housing are formed as a body unit, the number of components can be reduced. Further, a metallic case is attached to the body unit so as to cover said coil and bobbin and so that a space for insulation is present around said coil connection piece, and a cover portion is formed in said case to close said space for insulation. Therefore, occurrence of coil damaging and short-circuiting at the coil connection piece can be prevented. In this case, since the above cover portion is extended integrally from the connector housing, there is no fear of its falling-off and the number of components can be reduced. In addition, the cover portion has only to be molded integrally to the body unit so that production workability can be improved.

In the electromagnetic solenoid of the present invention, since the coil connection piece of said terminal piece may be made longer than the length extended out from said cover portion, the work of connecting the tip of the coil to the coil connection piece can be easily done. Further, since the coil connection piece can be bent in a state along the coil, the space for insulation which is present around the coil connection piece can be minimized.

DETAILED DESCRIPTION OF THE PREFERRED EMBODIMENTS

Figure 1B:
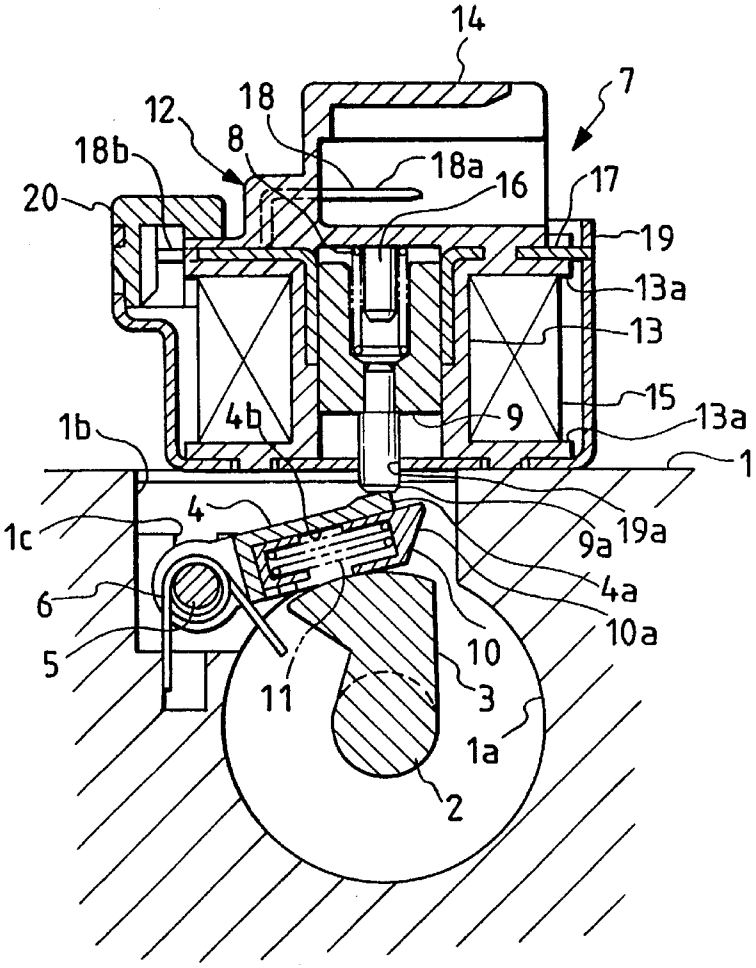
FIGS. 1 (*a*) and (*b*) are longitudinal sectional views showing a first embodiment of the present invention.

Now, referring to the drawings, the present invention will be explained in connection with an application to a key interlocking mechanism for a motor vehicle.

First Embodiment

Figure 1A:
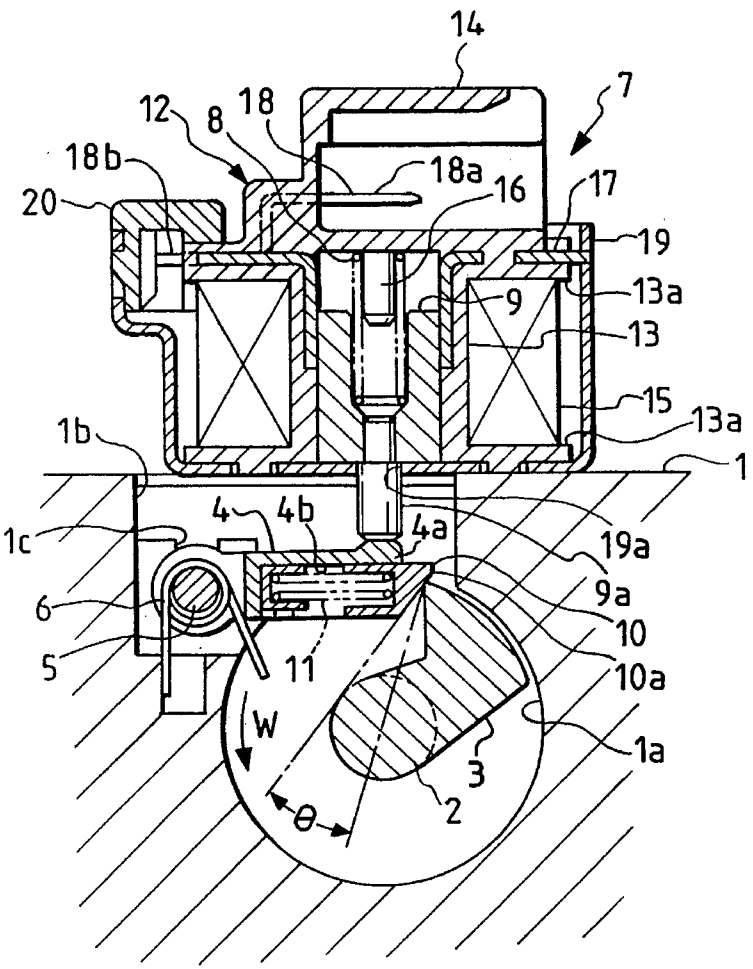
Figure 2:
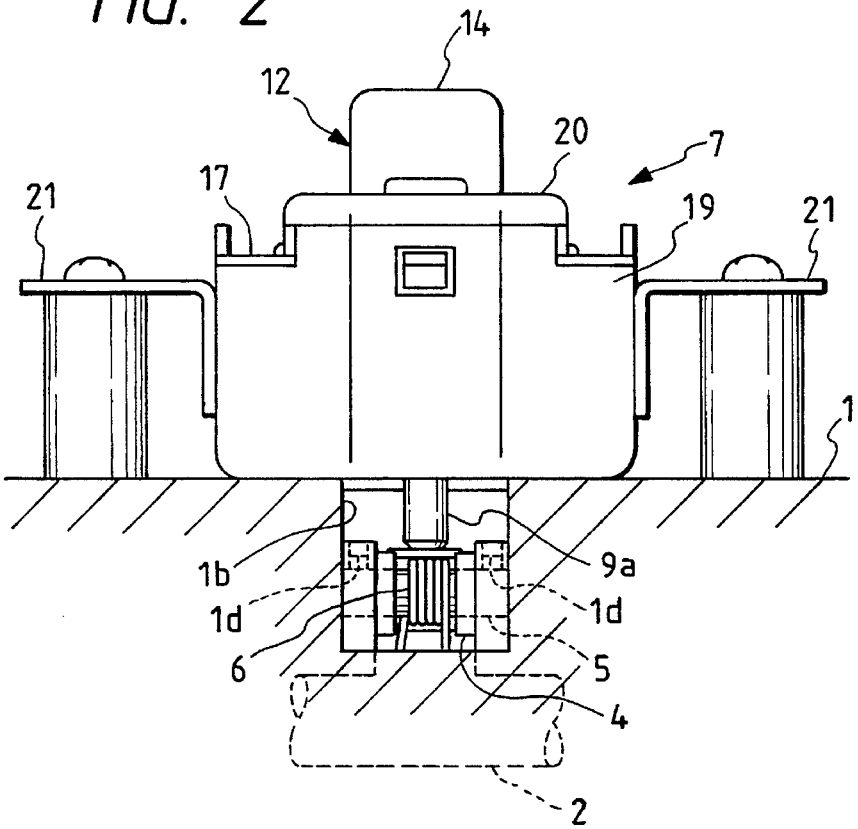
FIG. 2 is a side view of a partial section of the first embodiment of the present invention.

In FIGS. 1 and 2, a shaft 2 is made of e.g., zinc die-cast rotatably supported in a body 1. The shaft 2 is coaxially coupled with the key rotor for an ignition switch (not shown). The ignition key is adapted to rotate in interlock with the rotation of the ignition key to well-known operation positions (locking position, accessary position, on position and start position). In the outer periphery of the shaft 2, a protrusion 3 for a stopper is integrally formed. The stopper protrusion 3 resides at the position as shown in FIG. 1(*a*) when the ignition key is located at the accessary position. When the ignition key is rotated towards the locking position (i.e., in the direction of an arrow W) from this state, the stopper protrusion 3 is rotated to the position as shown in FIG. 1(*b*). Incidentally, the body 1 has a space la for assuring the rotating locus of the stopper protrusion 3.

Further, the body 1 has a through-hole 1*b* communicating with the space 1*a*, and a swinging lever 4 which reciprocates vertically is provided within the through-hole 1*b*. The swinging lever 4 is adapted to rotate around a pin 5 provided in a penetrating manner on the stem side. The swinging lever 4 makes to-and-from movements between the operating position (FIG. 1(*a*)) where it protrudes into the rotating locus of the stopper protrusion 3 and the operation-release position (FIG. 1(*b*)) where it escapes from the rotating locus. The pin 5 is held in such a manner that its both ends are inserted from above into a pair of slits 1*c* provided on opposite side walls of the through-hole 1*b*. Its falling-off is prevented by a protrusion 1*d* formed in the slit 1*c* (FIG. 2).

The swinging lever 4 is formed so that its tip abuts on the tip of the stopper protrusion 3. The tip 4*a* of the swinging lever 4 functions as a rotation controlling portion 4*a* which controls the rotation of the stopper protrusion 3 in contact with the tip of the stopper protrusion 3.

At the stem of the swinging lever 4, a twisting coil spring 6 forcing the swinging lever 4 upwards is provided. The spring force of such a twisting coil spring 6 is set for the value smaller than the downward force which is a total of the spring force of a compressing coil spring 8 within an electromagnetic solenoid 7 described later and the weight of the plunger 9 of the electromagnetic solenoid 7, compressing coil spring 8, and swinging lever 4. In this case, the electromagnetic solenoid 7 is so arranged that the pin 9*a* of the plunger 9 abuts on the swinging lever 4 from above and the spring force of the compressing coil spring 8 serves as force pushing the plunger 9 downwards. Thus, in a normal state, the swinging lever 4 is forced towards the lower operating position (position of FIG. 1(*a*)) by the spring force of the compressing coil spring 8, etc.

The swinging lever 4 has a slider-receiving hole portion 4*b* opened in its end surface. The slider-receiving hole 4*b* receives a slider made of material having self-lubricating property, e.g., polyacetals resin so that it reciprocates in the axial direction of the swinging lever 4.

In this case, the slider 10 reciprocates between the first position (FIG. 1(*a*)) and the second position (not shown). The first position is a position where the front surface of the slider 10 abuts on the tip of the stopper protrusion 3 earlier than the rotation controlling portion 4*a* when the stopper protrusion 3 is rotated toward the slider 10. The second position is a position recessed from the rotation controlling portion 4*a*.

The slider 10, when it is located on the first position, is positioned so that its front surface which is a surface abutting on the stopper protrusion 3 is inclined more shallow by an angle of θ (FIG. 1(*a*)) than the plane orthogonal to the rotation direction of the stopper protrusion 3. Thus, the front surface of the slider 10 serves as a cam surface 10*a*. As a result, while the slider 10 is held on the first position, with the electromagnetic solenoid 7 cut off electrically, when the shaft 2 is rotated in the direction of an arrow W as the ignition key is rotated from the accessary position to the locking position, the swinging lever 4 is pushed upwards by the above cam surface 10*a*. When the above rotation operation of the ignition key is continued, the swinging lever 4 is shifted towards the operation releasing position against the weight of the above compressing spring and plunger 9.

Further, the slider receiving hole 4*b* of the swinging lever 4 also receives a compressing coil spring 11 intervening between the slider 10 and the inner wall of the slider receiving hole 4*b*. The slider 10 is normally forced toward the first position normally by the compressing coil spring 11.

Figure 3:
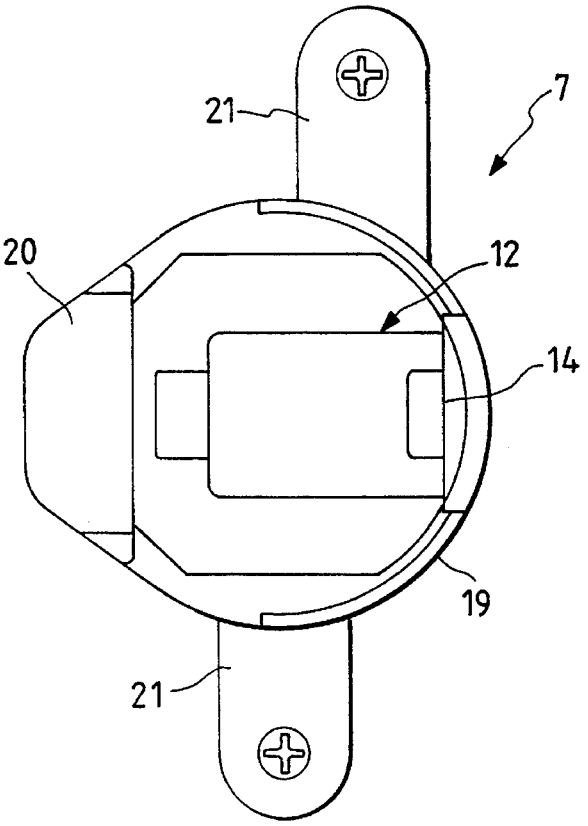
FIG. 3 is a plan view of the first embodiment of the present invention.

Also referring to FIG. 3, an explanation will be given of the structure of the above electromagnetic solenoid 7.

In the electromagnetic solenoid 7, a body unit 12 of plastic integrally includes a cylindrical bobbin 13 provided with flanges 13*a* at its upper and lower positions, and a connector housing 14 located on the bobbin 13. Around the outer periphery of the bobbin 13, a coil 15 is wound in a cylindrical shape, and within the bobbin 13, the plunger 9 is received movably vertically. At the portion corresponding to the ceiling of the bobbin 13, a guide pin 16 is projected downwards, and around the guide pin 16 the above compressing coil spring 8 is arranged.

To the body unit 12, a yoke 17 for leading the magnetic flux to the plunger 9 is fixed by insertion molding. In this case, the yoke 17 is structured so as to extend from the boundary between the bobbin 13 and connector housing 14 to the portion corresponding to the outer periphery of the plunger 9 along the inner periphery of the bobbin 13.

To the portion corresponding to the connector housing 14 in the body unit 12, a pair of terminal pieces 18 to which lead wires (not shown) drawn from both ends of the coil 15 are fixed by insertion-molding. In this case, each of the terminal pieces 18 is so structured that the terminal piece portion 18*a* on one side is protruded into the connector housing 14 and the coil connection portion 18*b* at the other end is protruded outward from the boundary between the bobbin 13 and the connector housing 14. Around the coil connection portion 18*b*, the lead wire drawn from both ends of the coil 15 is wound. The winding portion of such a lead wire can be fixed by e.g., soldering.

An auxiliary yoke 19 also serving as an outer case of the electromagnetic solenoid is formed in a vessel-shape covering the bobbin 13, coil 15 and the coil connection portion 18*b* of the terminal piece 18. The auxiliary yoke 19 is formed integrally to the body unit 12 by caulking the plural positions of the periphery to the yoke 17. At the center of the bottom of the auxiliary yoke 19, a hole 19*a* is formed for passing the pin 9*a* of the plunger 9. The size of the hole 19*a* is made smaller than that of the plunger 9. Thus, the plunger 9 normally abuts on the bottom of the auxiliary yoke 19 because of the spring force of the compressing coil spring 8.

The coil connection portion 18*b* is exposed from between the body unit 12 and the auxiliary yoke 19. The coil connection portion 18*b* is covered with a cover 20. The electromagnetic solenoid 7 is screwed to the body 1 through said protruding pieces 21 provided on both sides of the auxiliary yoke 19.

The electromagnetic solenoid 7 structured as described above holds the energization state when the automatic transmission for a motor vehicle, for example, is in a state other than a parking position and is cut off electrically when it is shifted to the parking position.

The spring force of the compressing coil spring 11 for forcing the slider 10 towards the first position is set for a value larger than the force (first force) acting on the slider 10 from the side of stopper protrusion 3 when the shaft 2 is rotated in the direction of an arrow W with the electromagnetic solenoid 7 being electrically cut off, and smaller than the force (second force) acting on the slider 10 when the shaft 2 is rotated in the direction of an arrow W with the electromagnetic coil 7 being electrically energized. The first force is equal to the subtraction of the upward force due to the twisting coil spring 6 from the downward force corresponding to the spring force of the compressing coil 8 in the electromagnetic solenoid 7 and weight of the plunger 9. The second force is equal to the addition of the above downward force and the adsorption force of the electromagnetic solenoid 7.

The reason described above leads to the following results. Now, in the cut-off state of the electromagnetic solenoid 7, i.e., where the automatic transmission is in a parking position, it is assumed that the shaft 2 is rotated in the direction of an arrow W as the ignition key is shifted toward the locking position and the tip of the stopper protrusion 3 abuts on the slider 10. Then, the slider 10 remains held in the first position. Thus, the swinging lever 4 is pushed up from the cam surface 10*a* so that the shaft 2 is permitted to rotate. As a result, the ignition key can be rotated in the position of locking as shown in FIG. 1(*b*).

On the other hand, in the energized state of the electromagnetic solenoid 7, i.e., where the automatic transmission is in a state other than the parking position, it is assumed that the shaft 2 is rotated in the direction of an arrow W as the ignition key is shifted toward the locking position and the tip of the stopper protrusion 3 abuts on the slider 10. In this case, the compressing spring 11 is thereafter compressed and deformed so that the slider 10 will be shifted to the second position. As a result, the function of the cam surface 10*a* will be invalidated. The tip of the stopper protrusion 3 therefore abuts on the rotation controlling portion 4 to restrain the rotation of the stopper protrusion 3, and hence the rotation of the ignition key toward the locking position is inhibited.

In this case, the electromagnetic solenoid 7 has only to create relatively small attraction force that is slightly larger than the force resulting from subtraction of the downward force corresponding to the spring force of the compressing coil 8, weight of the plunger 9, etc., from the spring force of the compressing coil spring 11. The electromagnetic solenoid 7 according to this embodiment which is formed in a core-less shape does not lead to any inconvenience in an actual use.

As described above, the electromagnetic solenoid 7 according to this embodiment does not provide large adsorption force because of absence of the core unlike the conventional structure, but can achieve light-weight of itself. The electromagnetic solenoid 7 according to this embodiment, therefore, is preferable for the means for driving the load for a motor vehicle in which reduction of weight is required. Further, in this embodiment as described above, a unit body is provided which integrally includes the connector housing 14 with the terminal piece 18 insertion-molded for supplying power to the coil 15 and the bobbin 13 around which the coil 15 is wound, and the yoke 17 is insertion-molded in the body unit 12. Because of such a structure, the number of components can be reduced.

Since the auxiliary yoke 19 is provided so as to cover said coil 15 and a connection portion 18*b* between said coil 15 and said terminal piece 18, damaging of the coil 15 and short-circuiting at the terminal piece 18 can be prevented.

In the above embodiment, the auxiliary yoke 19 was also used as a case for the electromagnetic solenoid 7, but the auxiliary yoke and case may be provided for exclusive use, respectively.

Second Embodiment

Now, referring to FIGS. 4 to 6, an explanation will be given of the second embodiment of the present invention.

Figure 4:
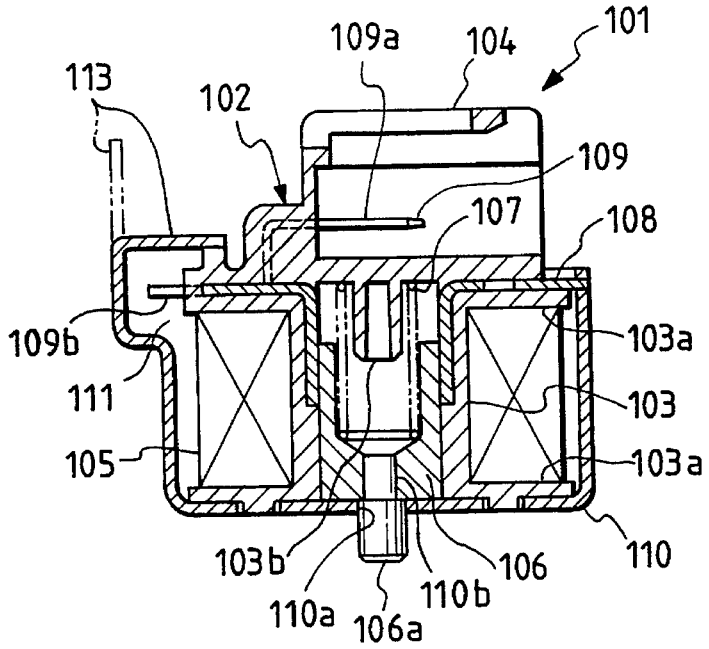
FIG. 4 is a longitudinal sectional view showing a second embodiment of the present invention.
Figure 5:
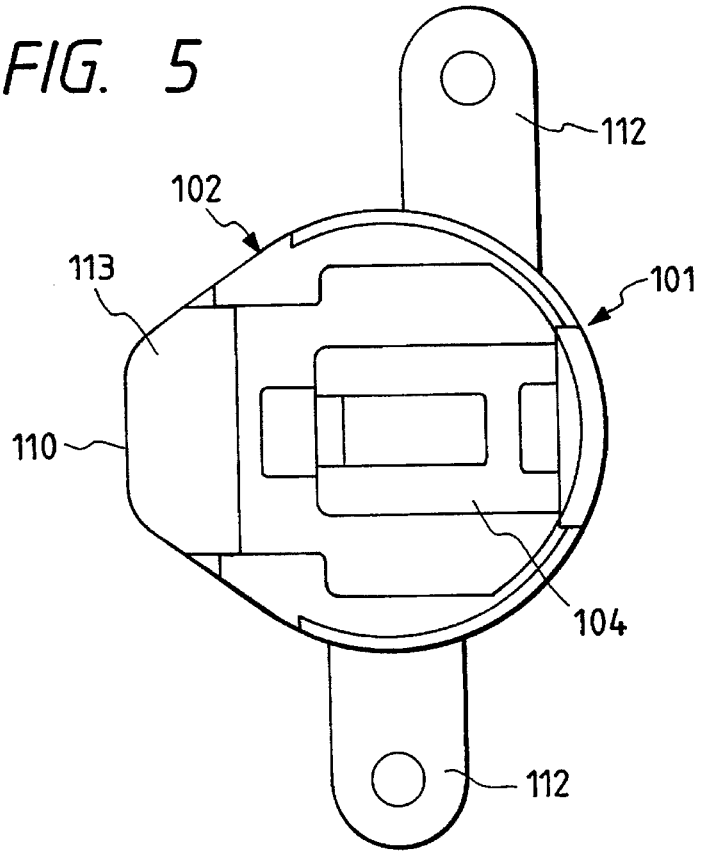
FIG. 5 is a plan view of the second of the present invention.
Figure 6:
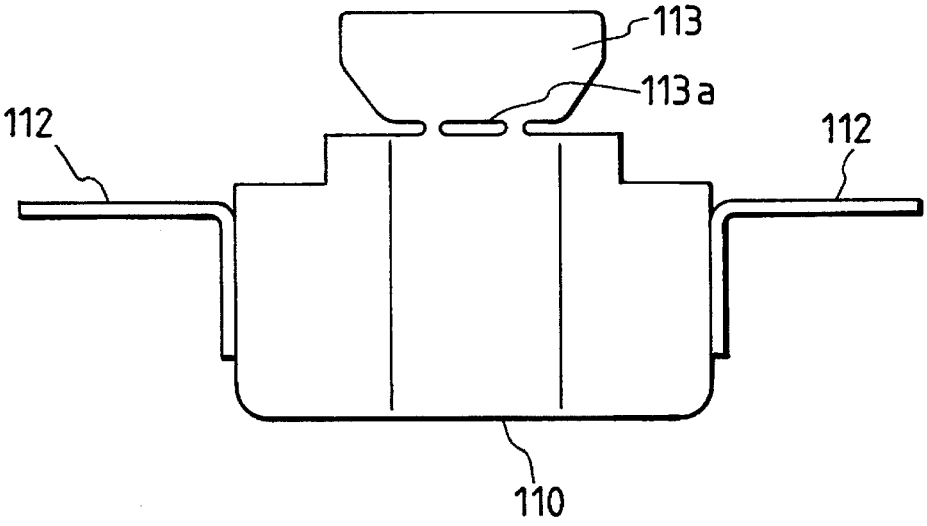
FIG. 6 is a front view of the case before a cover member is bent.

FIGS. 4 and 5 are a longitudinal sectional view and a plan view of an electromagnetic solenoid 101. In FIGS. 4 and 5, a body unit 102 integrally includes a cylindrical bobbin 103 having upper and lower flanges 103*a* and a connector housing 104 located on the bobbin 103. Around the outer periphery of the bobbin 103, a coil 105 is wound cylindrically, and within the bobbin 103, a plunger 105 is accommodated to be vertically movable. From the ceiling of the bobbin 103, a guide pin 103*b* united with the bobbin 103 is protruded downward. Around the guide pin 103*b*, a compressing coil spring 107 normally urging the plunger 106 downward is arranged.

To the body unit 102, a yoke 108 which leads the magnetic flux from the coil 105 to the plunger 106 is fixed by insertion-molding. In this case, the yoke 108 is extended from the boundary between the bobbin 103 and connector housing 104 to the portion corresponding to the outer periphery of the plunger 106 along the inner periphery of the bobbin 103.

At the connector housing 104 of the body unit 102, a pair of terminal pieces 109 connected to the lead wires (not shown) drawn out from both ends of the coil 105 are insertion-molded. In this case, each of terminal pieces 109 is so structured that a lead piece 109*a* at one end is protruded into the connector housing 104 and the coil connection piece 109*b* is protruded outward from the side of the body unit 102, particularly, from the boundary between the bobbin 103 and the connector housing 104. Around the coil connection piece 109*b*, the coil terminal (not shown) from both ends of the coil 105 is wound. The winding portion of the coil terminal is fixed by soldering.

A case 110 is made of magnetic material (e.g., iron) so that it can also serve as the yoke of the electromagnetic solenoid 101. It covers the bobbin 103, coil 105 and coil connection terminal piece 109*b* of the terminal piece 109 so that a space 111 for insulation whose upper portion is opened around the coil connection place 109*b* of the terminal piece 109. The case 110 is formed integrally to the body unit 102 by caulking the plural positions of the periphery of the case to the yoke 108.

In this case, the plunger 106 normally abuts on the bottom of the case 110*b* because of the spring force of the compressing coil spring 107 in such a manner that its pin 106*a* is caused to pass through the hole 110*a* formed at the center of the bottom of the case 110. In the state where the coil 105 is electrically energized, the force required to release the abutting state becomes larger than in the normal state. On both sides of the case 110, a pair of projection pieces 112 (FIG. 5) for attaching the electromagnetic solenoid 101 to a predetermined position are provided.

At the portion corresponding to the space 111 for insulation at the edge of the upper end of the case 110, a cap member 113 united with the case 110 is formed for closing the upper opening of the space 111 for insulation. Before the case 110 is mounted in the body unit 102, the cap member 113 is held in a state indicated by a two-dot chain line in FIG. 4. After the case 110 is mounted in the body unit 102, the cap member 113 is bent so as to close the upper opening of the space 111 for insulation and its tip abuts on the body unit 102 as indicated by a solid line in FIG. 4. The portion uniting the cover member 113 with the case 110 is formed in a narrow-width shape including a slit-like through-hole 113*a* as shown in FIG. 6 showing the state before the cover member 113 is bent, thus permitting the cover member 113 to be easily bent there.

In the electromagnetic solenoid structured as described above, since a bobbin 103 around which a coil 105 is wound and a connector housing 104 with insertion-molded terminal pieces for supplying power to the coil 105 are integrally formed as a body unit of plastic, the number of components can be reduced. Since a yoke 108 is also insertion-molded in the body unit 102, the number of components can be further reduced.

Further, since a metallic case is attached to the body unit so as to cover the coil 105 and bobbin 103 and so that a space 111 for insulation is present around the coil connection piece 109*b* of the terminal piece 109 and a cap member 113 is formed to close the space 111 for insulation. Occurrence of damaging of the coil 105 and short-circuiting at the coil connection piece 109*b* can be prevented. In this case, since the above cap member 113 is formed integrally to the case 110, there is no fear of its falling-off and the number of components can be reduced. In addition, the cap member 113 has only to be bent to close the space for insulation so that production workability can be improved. Further, the cap member 113 abuts on the body unit in its bent state so that it is prevented from being dropped in the space for insulation.

Third Embodiment

Figure 7:
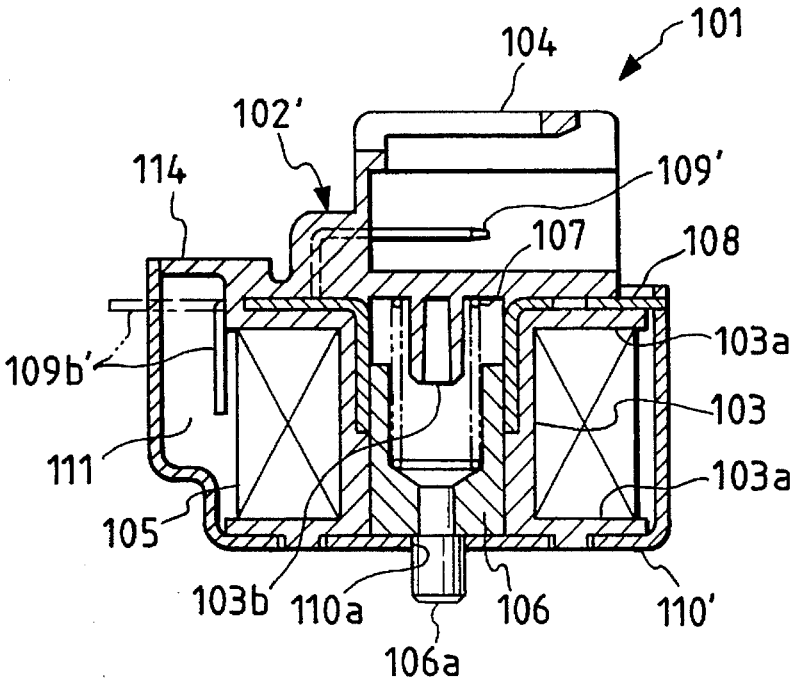
FIG. 7 is a longitudinal sectional view showing a third embodiment of the present invention.

The third embodiment of the present invention is shown in FIG. 7. Only the different portions from the first embodiment will be explained.

The body unit 102' is provided with a cover portion 114 extended out integrally from the connector housing 104. The cover portion 114 serves to close the upper opening of the space 111 for insulation. A coil connection piece 109*b'* of the terminal piece 109 insertion-molded in the connector housing 104, after it is electrically connected to the coil terminal of the coil 105, is bent in a state along the coil 105. In this case, since the coil connection piece 109*b* is formed to be longer than the extended length of the cover portion 114, before its bending, it is protruded more outward than the cover portion 114 as indicated by two-dot chain line. Incidentally, a case 110' is so formed that the space 111 for insulation corresponding to the coil connection piece 109*b'* is present around the coil connection piece 109*b'* after bending.

In this embodiment also, as in the second embodiment, the number of components can be reduced, and occurrence of damaging of the coil 105 and short-circuiting at the coil connection piece 109*b'* can be prevented. In this case, since the cover portion 114 serving to close the space 111 for insulation is extended integrally from the connector housing 104, there is no fear of its falling-off and the number of components can be reduced. In addition, the cover portion 114 has only to be previously formed integrally to the body unit 102' so that production workability can be improved. Further, since the coil connection piece 109*b'*, before its bending, is protruded more outward than the-cover portion 114, it can be easily connected to the coil terminal of the coil 105. Further, since the coil connection piece 109*b'*, after it is electrically connected to the coil terminal of the coil 105, is bent in a state along the coil 105, the space 111 for insulation which is present around the coil connection piece 109*b* can be minimized, thus preventing the size of the entire structure from being increased.

In accordance with the present invention, as apparent from the above description, the electromagnetic coil has a structure comprising a body unit of plastic integrally including a cylindrical bobbin around which a coil is wound and a connector housing with an insertion-molded terminal piece for supplying power to the coil; a plunger arranged in said bobbin; and a yoke fixed on said body unit, by insertion molding, to lead magnetic fluxes from said coil onto the side of said plunger. Because of such a structure which can achieve the light-weight, the electromagnetic solenoid according to the present invention is preferable for the means for driving the load for a motor vehicle and can reduce the number of components.

In accordance with the present invention, as is apparent from the description made hitherto, in a structure wherein a bobbin around which a coil is wound and a connector housing are integrally formed as a body unit and there are also provided a terminal piece insertion-molded in the connector housing so that its coil connection piece is protruded from side of the body unit and a metallic case attached to said body unit so as to cover said coil and bobbin and so that a space for insulation is present around said coil connection piece, a cover member is integrally formed in said case so that it is bent to close the space for insulation and its tip abuts on said body unit, or a cover portion is integrally formed at said body unit so that it is extended integrally from said connector housing to close said space for insulation. Because of such a structure, reduction in the number of components and improvement in the production workability can be realized, and falling-off of the cap member or the cover potion can be surely prevented.

What is claimed is:

1. An electromagnetic solenoid comprising:

a body unit of plastic integrally including a cylindrical bobbin around which a coil is wound and a connector housing;

a plunger arranged in said bobbin;

a yoke fixed on said body unit, by insertion molding, to lead magnetic fluxes from said coil onto the side of said plunger;

a terminal piece insertion-molded to said body unit in a protruding manner into said connector housing, a coil connection piece of said terminal piece for connecting the terminal of said coil protruding from the side portion of said body unit; and a case attached to said body unit to cover said coil and said bobbin with an insulation space defined around said coil connection piece.

2. An electromagnetic solenoid as claimed in claim 1, wherein a cap member is formed integrally to said case, the cap member is bent to close said insulation space, and a tip of the cap member abuts on said body unit.

3. An electromagnetic solenoid as claimed in claim 1, wherein a cover portion is formed integrally to said unit, and the cover portion is extended integrally from said connector housing to close said insulation space.

4. An electromagnetic solenoid as claimed in claim 3, wherein the coil connection piece of said terminal piece is longer than the length extended out from said cover portion and the coil connection piece is bent along said coil.

5. A key interlocking mechanism comprising:

an electromagnetic solenoid including:

a body unit of plastic integrally including a cylindrical bobbin around which a coil is wound and a connector housing;

a plunger arranged in said bobbin;

a yoke fixed on said body unit, by insertion molding, to lead magnetic fluxes from said coil onto the side of said plunger;

a terminal piece insertion-molded to said body unit in a protruding manner into said connector housing, a coil connection piece of said terminal piece for connecting the terminal of said coil protruding from the side portion of said body unit;

a case attached to said body unit to cover said coil and said bobbin with an insulation space defined around said coil connection piece;

a swinging lever rotating around a pin provided with a body to move in vertical direction, the swing lever including:

a twisting coil spring urging the swing lever in upwardly, provided at a proximal portion of the swing lever;

a slider accommodated in a slider-receiving hole opened in an end surface of the swinging lever reciprocate with respect to the pin, the slider being brought into contact with the plunger, a cam surface provided on a distal end thereof;

a compressing coil spring disposed between the swinging lever and the slider;

a shaft provided with a stopper protrusion at an outer periphery of the shaft.

6. An electromagnetic solenoid as claimed in claim 5, wherein a cap member is formed integrally to said case, the cap member is bent to close said insulation space and its tip abuts on said body unit.

7. An electromagnetic solenoid as claimed in claim 5, wherein a cover portion is formed integrally to said unit, and the cover portion is extended integrally from said connector housing to close said insulation space.

8. An electromagnetic solenoid as claimed in claim 7, wherein the coil connection piece of said terminal piece is longer than the length extended out from said cover portion and the coil connection piece is bent along said coil.

* * * * *